US009555629B2

(12) United States Patent
Shibata et al.

(10) Patent No.: US 9,555,629 B2
(45) Date of Patent: Jan. 31, 2017

(54) LIQUID DISCHARGE SUBSTRATE, LIQUID DISCHARGE HEAD, AND PRINTING APPARATUS

(71) Applicant: CANON KABUSHIKI KAISHA, Tokyo (JP)

(72) Inventors: Masanori Shibata, Inagi (JP); Kazunari Fujii, Tokyo (JP); Takaaki Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/697,548

(22) Filed: Apr. 27, 2015

(65) Prior Publication Data

US 2015/0314597 A1 Nov. 5, 2015

(30) Foreign Application Priority Data

Apr. 28, 2014 (JP) ..... 2014-093087

(51) Int. Cl.
*B41J 2/045* (2006.01)

(52) U.S. Cl.
CPC ..... *B41J 2/04598* (2013.01); *B41J 2/0452* (2013.01); *B41J 2/0458* (2013.01); *B41J 2/04541* (2013.01); *B41J 2/04543* (2013.01); *B41J 2/04573* (2013.01)

(58) Field of Classification Search
CPC . B41J 2/04501; B41J 2/04543; B41J 2/04573; B41J 2/355; B41J 2/3551; B41J 2/04541
See application file for complete search history.

(56) References Cited

U.S. PATENT DOCUMENTS 6,460,976 B1 * 10/2002 Oikawa ..... B41J 2/04541 347/57
2008/0100649 A1 * 5/2008 Matsui ..... B41J 2/04541 347/9
2008/0238969 A1 * 10/2008 Kasai ..... B41J 2/04541 347/12

FOREIGN PATENT DOCUMENTS

JP 2004-050846 A 2/2004

* cited by examiner

*Primary Examiner* — Julian Huffman
*Assistant Examiner* — Sharon A Polk
(74) *Attorney, Agent, or Firm* — Canon U.S.A. Inc., IP Division

(57) ABSTRACT

A liquid discharge substrate according to an embodiment of the present invention includes a plurality of heating elements, a plurality of driving elements, a signal supplying unit which supplies a control signal used to control the plurality of driving elements, and a plurality of delay circuits which delay the control signal. A delay amount of a first delay circuit is different from a delay amount of a second delay circuit.

21 Claims, 9 Drawing Sheets

LIQUID DISCHARGE SUBSTRATE, LIQUID DISCHARGE HEAD, AND PRINTING APPARATUS

BACKGROUND OF THE INVENTION

Field of the Invention

The present invention relates to a liquid discharge substrate, a liquid discharge head, and a printing apparatus.

Description of the Related Art

In recent years, discharge elements which discharge liquid, such as ink, have been used as printing elements of printing apparatuses. A liquid discharge substrate disclosed in Japanese Patent Laid-Open No. 2004-050846 includes a plurality of heating elements as the discharge elements. A plurality of driving elements are disposed so as to correspond to the plurality of heating elements. A driving pulse which determines a timing of driving of the heating elements is input from a single pad and is supplied to the plurality of driving elements. The liquid discharge substrate disclosed in Japanese Patent Laid-Open No. 2004-050846 further includes a plurality of delay circuits disposed in a transmission path for the driving pulse. The delay circuits may differentiate timings when the driving pulse is applied to the plurality of driving elements. With this configuration, the liquid discharge substrate disclosed in Japanese Patent Laid-Open No. 2004-050846 differentiates timings when the plurality of heating elements are driven.

SUMMARY OF THE INVENTION

The present invention provides a liquid discharge substrate including a plurality of discharge elements configured to receive a power source supplied from a common power source line, a plurality of driving elements configured to drive the plurality of discharge elements, a signal supplying unit configured to supply a control signal for controlling the plurality of driving elements, and a plurality of delay circuits disposed in a signal path which transmits the control signal. The plurality of driving elements include first, second, and third driving elements. The plurality of delay circuits include first and second delay circuits. The first delay circuit delays a timing when the discharge element corresponding to the second driving element is driven relative to a timing when the discharge element corresponding to the first driving element is driven. The second delay circuit delays a timing when the discharge element corresponding to the third driving element is driven relative to the timing when the discharge element corresponding to the second driving element is driven. A delay amount of the first delay circuit is different from a delay amount of the second delay circuit.

Further features of the present invention will become apparent from the following description of exemplary embodiments with reference to the attached drawings.

DESCRIPTION OF THE EMBODIMENTS

According to embodiments described below, malfunction of discharge elements may be reduced.

In liquid discharge substrates generally known by the inventors, overlap between timings of transition of a driving pulse may occur depending on a length of the driving pulse. The expression "overlap between timings of transition of a driving pulse" means overlap between a falling timing of the driving pulse applied to a certain driving element and a rising timing of the driving pulse applied to another driving element. The inventors found that the overlap between timings of transition of a driving pulse causes malfunction of heating elements. In particular, if delay amounts of delay circuits are the same as one another, the number of times the overlap between timings of transition of a driving pulse occurs is likely to be large.

Accordingly, the embodiments below may attain reduction of malfunction of a plurality of discharge elements included in a liquid discharge substrate.

As an embodiment of the present invention, a liquid discharge substrate includes discharge elements which discharge liquid, such as ink. As another embodiment of the present invention, a liquid discharge head includes the liquid discharge substrate and a liquid supplying unit which supplies liquid, such as ink, to the liquid discharge substrate. The liquid discharge head is used as a printing head of a printing apparatus, for example. As a further embodiment of the present invention, a printing apparatus includes the liquid discharge head and a driving unit which drives the liquid discharge head. Examples of the printing apparatus include a printer and a copier. The liquid discharge substrate according to one of the embodiments of the present invention is applicable to apparatuses used to fabricate a three-dimensional structure, a DNA chip, an organic transistor, and a color filter.

Figure 1:
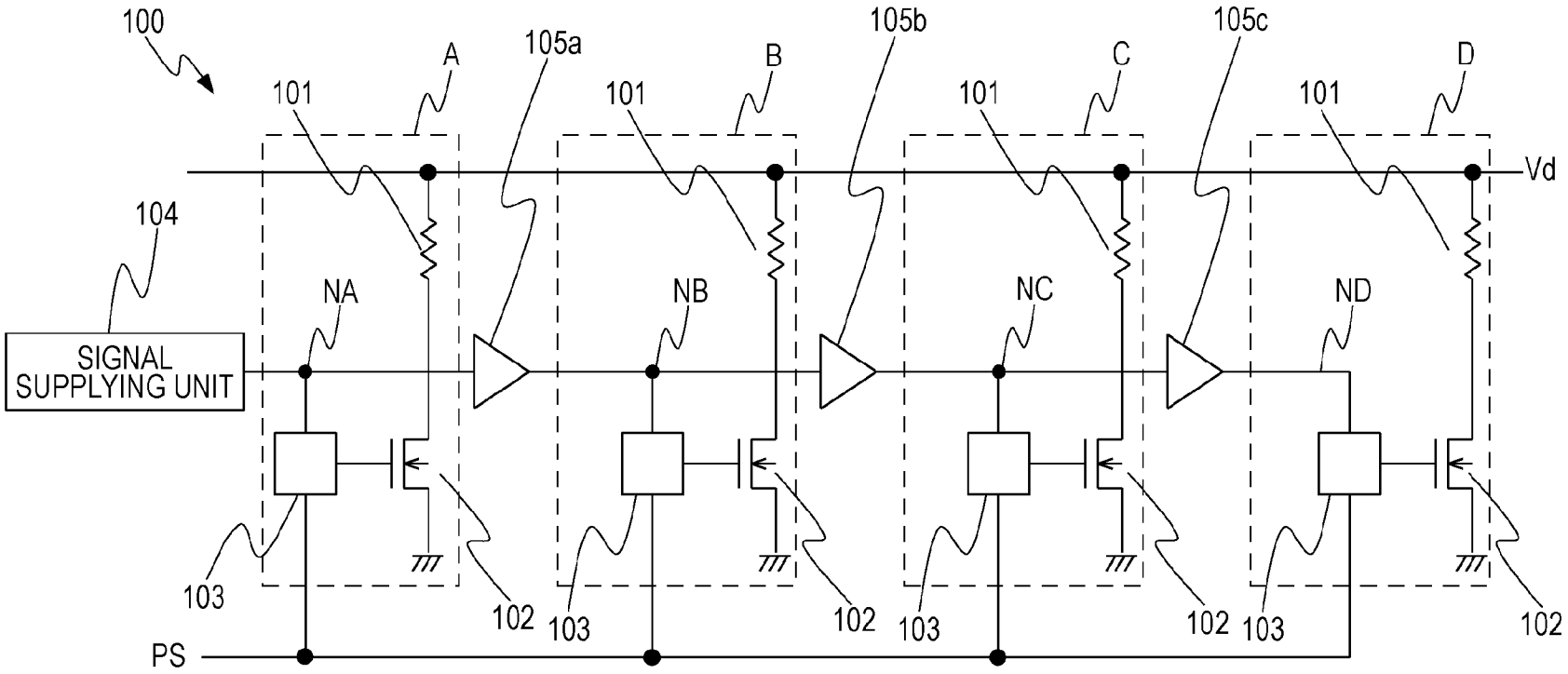
FIG. 1 is an equivalent circuit illustrating a configuration of a liquid discharge substrate.

The liquid discharge substrate includes a plurality of discharge elements disposed thereon. As the discharge elements, elements which convert electric energy into energy for discharging liquid, such as heating elements or piezoelectric elements, are used. In FIG. 1, heating elements 101 are illustrated as examples of the discharge elements.

A plurality of driving elements are disposed so as to correspond to the plurality of discharge elements. In FIG. 1, driving elements 102 are illustrated. As the driving elements, transistors are used, for example. The driving elements supply electric energy to the corresponding discharge elements in response to a supplied control signal.

The liquid discharge substrate includes a signal supplying unit which supplies a control signal for controlling the plurality of driving elements. In FIG. 1, a signal supplying unit 104 is illustrated. The signal supplying unit is a circuit which generates a control signal in accordance with a signal externally input, for example. Alternatively, the signal supplying unit 104 is a pad electrode which receives a control signal externally input, for example. The control signal which is supplied from the signal supplying unit is a driving pulse having rising of a voltage and falling of the voltage, for example. In this specification, a period of time from the rising of the voltage to the falling of the voltage is referred to as a pulse width. Note that, depending on an electric polarity of a driving element, the pulse width may be defined by a period of time from falling of a voltage to rising of the voltage.

The liquid discharge substrate includes a plurality of delay circuits. In FIG. 1, a plurality of delay circuits 105 are illustrated. The plurality of delay circuits are arranged in a signal path which transmits the control signal supplied from the signal supplying unit. Each of the delay circuits outputs a signal input to an input node thereof from an output node thereof after delaying the input signal by a predetermined period of time. Therefore, a timing when a discharge element corresponding to a driving element on an output node side of the delay circuit is driven delays relative to a timing when a discharge element corresponding to a driving element on an input node side of the delay circuit is driven. The delay circuits 105 are logic circuits, such as inverter circuits, or CR circuits including a resistance and a capacitance, for example.

In the liquid discharge substrate according to an embodiment, the plurality of delay circuits include two delay circuits having different delay amounts. With this configuration, overlap between timings of transition of a driving pulse may be reduced. The expression "overlap between timings of transition of a driving pulse" means overlap between a falling timing of a driving pulse applied to a certain driving element and a rising timing of the driving pulse applied to another driving element. Consequently, malfunction of the discharge elements may be reduced.

Delay times of the two delay circuits may be differentiated by differentiating gate lengths of transistors included in the two delay circuits. Alternatively, delay times of the two delay circuits may be differentiated by differentiating the numbers of stages of logic gates included in the two delay circuits. Alternatively, delay times of the two delay circuits may be differentiated by differentiating time constants of the two delay circuits. A time constant is determined using a resistance value and a capacitance value.

In the liquid discharge substrate of another embodiment, a plurality of discharge elements are arranged in a plurality of blocks in a divided manner. One block includes at least two discharge elements. The discharge elements included in one block are controlled by a common driving element. Then the plurality of delay circuits are disposed between driving elements included in two blocks which are arranged adjacent to each other in a signal path. With this configuration, overlap between timings of transition of a driving pulse may be reduced. Consequently, malfunction of the discharge elements may be reduced.

Hereinafter, embodiments of the present invention will be described with reference to the accompanying drawings. Embodiments of the present invention are not limited to the embodiments described below. For example, a case where part of a configuration of one of the embodiments is added to one of the other embodiments or a case where part of one of the embodiments is replaced by part of one of the other embodiments are also included in embodiments of the present invention.

First Embodiment

A first embodiment will be described. FIG. 1 is an equivalent circuit representing a configuration of a liquid discharge substrate 100.

The liquid discharge substrate 100 includes a plurality of heating elements 101. The heating elements 101 serve as discharge elements. The plurality of heating elements 101 are arranged in four blocks A to D in a divided manner. In this specification, when each of the heating elements 101 is referred to, an alphabet representing one of the blocks including the heating element 101 is added to a reference numeral. For example, a heating element 101A represents a heating element included in the block A. On the other hand, when an item which is common to the plurality of heating elements 101 is described, only a reference numeral is described. The same is true for elements other than the heating elements 101 and circuits.

One terminal of the heating element 101 is connected to a node which receives a power source voltage Vd supplied thereto. The other terminal of the heating element 101 is grounded through a driving element 102. The driving element 102 functions as a switch which controls driving of the heating element 101. The driving element 102 drives the heating element 101 in response to a control signal. Specifically, when the driving element 102 becomes in a conductive state, current is supplied to the heating element 101 and the heating element 101 heats. The driving element 102 is an N-type MOS transistor, for example. A drain is connected to the heating element 101 and a source is grounded. When a MOS transistor of a high withstand voltage, such as a DMOS, is used, large energy may be supplied to the heating element 101.

A selection circuit 103 which selects the heating element 101 to be driven is connected to the driving element 102. A selection signal PS and a control signal which is supplied from the signal supplying unit 104 are input to the selection circuit 103. The selection signal PS is printing data which is externally input, for example. A control signal is supplied from the signal supplying unit 104 to the driving element 102 selected by the selection signal PS through the selection circuit 103. Note that the selection circuit 103 is omitted in an embodiment in which all heating elements 101 are driven at all time.

The liquid discharge substrate 100 of this embodiment includes a plurality of delay circuits 105. The delay circuit 105 delays an input signal by a predetermined period of time. Therefore, a timing when the control signal is supplied to a driving element 102 on an output node side of the delay circuit 105 may delay relative to a timing when the control signal is supplied to a driving element 102 on an input node side of the delay circuit 105.

A period of time from when a signal is input to an input node of the delay circuit 105 to when the signal is output from an output node corresponds to a delay amount of the delay circuit 105. In general, when a signal is transmitted through a line, delay may occur due to a parasitic resistance of the line or a parasitic capacitance of the line. The delay circuit 105 may obtain a delay amount larger than an amount of delay caused by a line when the delay circuit 105 includes a transistor, a resistance element, or a capacitance element.

In this embodiment, three delay circuits 105*a* to 105*c* are disposed in the signal path which transmits the control signal supplied by the signal supplying unit 104. The delay circuit 105*a* is disposed between the driving element 102A of the block A and the driving element 102B of the block B in the signal path. With this configuration, the delay circuit 105*a* may delay a timing when the control signal is supplied to the driving element 102B relative to a timing when the control signal is supplied to the driving element 102A.

The delay circuit 105*b* is disposed between the driving element 102B of the block B and the driving element 102C of the block C in the signal path. With this configuration, the delay circuit 105*b* may delay a timing when the control signal is supplied to the driving element 102C relative to a timing when the control signal is supplied to the driving element 102B.

The delay circuit 105*c* is disposed between the driving element 102C of the block C and the driving element 102D of the block D in the signal path. With this configuration, the delay circuit 105*c* may delay a timing when the control signal is supplied to the driving element 102D relative to a timing when the control signal is supplied to the driving element 102C.

Figure 2:
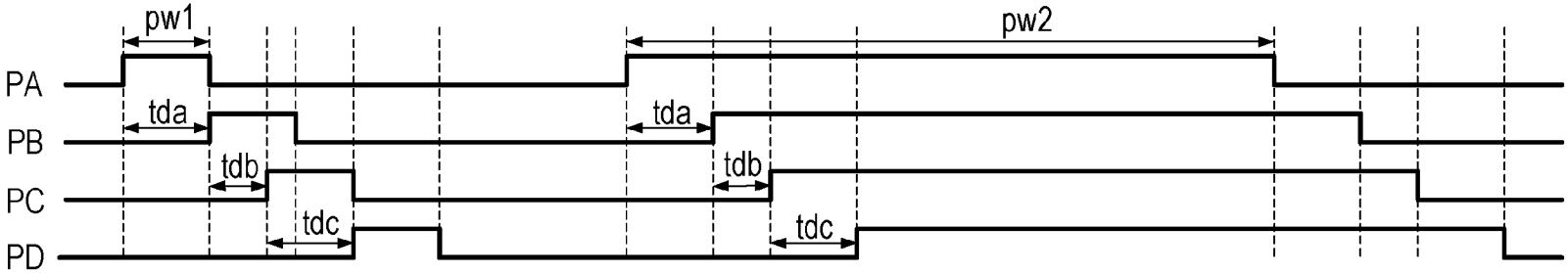
FIG. 2 is a diagram schematically illustrating a timing chart of a control signal.

Next, a mechanism in which the delay circuit 105 delays the control signal supplied from the signal supplying unit 104 will be described. FIG. 2 is a diagram schematically illustrating a timing chart of the control signal. Control signals PA to PD of FIG. 2 represent waveforms of the control signal in nodes NA to ND of FIG. 1.

An axis of ordinate of FIG. 2 represents a signal level of the control signal. The control signal of this embodiment uses a voltage as the signal level. Therefore, the axis of ordinate of FIG. 2 represents a voltage of the control signal. The driving element 102 drives the heating element 101 while the signal is in a high level. Note that, in a liquid discharge substrate in a modification, a driving element 102 drives a heating element 101 while a signal is in a low level.

The control signal is successively supplied to the nodes NA to ND of FIG. 1 from the signal supplying unit 104 through the plurality of delay circuits 105*a* to 105*c* disposed in the signal path. Therefore, the control signals PA to PD have substantially the same waveform.

Delay of the control signal supplied to the node NA from the signal supplying unit 104 is negligible. The control signal PA of the node NA is input to the selection circuit 103A and the delay circuit 105*a*.

The control signal PB to be supplied to the node NB is delayed by the delay circuit 105*a* by a delay amount tda relative to the control signal PA. The control signal PB of the node NB is input to the selection circuit 103B and the delay circuit 105*b*.

The control signal PC to be supplied to the node NC is delayed by the delay circuit 105*b* by a delay amount tdb relative to the control signal PB. The control signal PC of the node NC is input to the selection circuit 103C and the delay circuit 105*c*.

The control signal PD to be supplied to the node ND is delayed by the delay circuit 105*c* by a delay amount tdc relative to the control signal PC. The control signal PD of the node ND is input to the selection circuit 103D.

In this embodiment, the delay amount tda of the delay circuit 105*a* and the delay amount tdb of the delay circuit 105*b* are different from each other. Furthermore, the delay amount tdc of the delay circuit 105*c* is equal to the delay amount tda of the delay circuit 105*a*.

As described above, the liquid discharge substrate 100 of this embodiment includes at least two delay circuits 105 having different delay amounts. Therefore, overlap between timings of transition of the control signal may be reduced. For example, a timing when a signal level of the control signal PB falls and a timing when a signal level of the control signal PC rises may be shifted from each other.

The overlap between timings of transition of the control signal causes generation of noise in the circuits included in the liquid discharge substrate 100. An example of this case will be described. When the signal level of the control signal changes, a conductive state of the driving element 102 changes. At this time, excessive current is supplied to a circuit including the driving element 102 and circuit connected to the driving element 102. A power supply voltage may be changed due to the excessive current. The power source voltage is considerably changed when timings of transition of the control signal overlap with each other. A logic circuit used to process printing data may malfunction due to the large change of the power source voltage. As a result, the discharge elements may malfunction. Accordingly, the malfunction of the discharge elements may be reduced by reducing the overlap between timings of transition of the control signal.

As a comparative example, a case where a liquid discharge substrate having the circuit configuration illustrated in FIG. 1 is employed and the delay circuits 105*a* to 105*c* have the same delay amount td will be described. In this comparative example, overlap of transition of a control signal may occur at most three times. Specifically, when a period of time from rising of a signal level of the control signal to falling of the signal level of the control signal is equal to the delay amount td, the overlap of transition of the control signal occurs three times.

On the other hand, in this embodiment, the delay amount tda of the delay circuit 105*a* and the delay amount tdb of the delay circuit 105*b* are different from each other. Therefore, the overlap between timings of transition of the control signal occurs at most twice. That is, the maximum number of times in which the overlap between timings of transition of the control signal occurs may be reduced when compared with the comparative example. Consequently, possibility of malfunction of the discharge elements may be reduced.

In a normal operation, the control signal is supplied from an external apparatus, such as a printing apparatus, to the liquid discharge substrate 100, and therefore, a signal having an arbitrary waveform is used as the control signal. However, in a case where delay amounts of all delay circuits are the same as one another, a control signal to be input to a liquid discharge substrate may be restricted so that overlap between timings of transition of the control signal is prevented. As an example of the restriction, a period of time from rising to falling of a signal level becomes larger than a sum of the delay amounts of all the delay circuits. On the other hand, the liquid discharge substrate 100 of this embodiment includes the plurality of delay circuits 105 having different delay amounts. With this configuration, the maximum number of times in which the overlap between timings of transition of the control signal occurs may be reduced. Therefore, the restriction of the control signal is relaxed, and accordingly, the liquid discharge substrate 100 may be used more for multipurpose.

Note that the timings when the control signals PA to PD are input to the selection circuits 103 and a timing when the driving elements 102 are turned on so that current is supplied to the heating elements 101 may be shifted from each other. However, since an amount of delay caused by the selection circuit 103 is small, this delay is ignored in this embodiment and noise is generated at a timing when the signal level of the control signal is changed.

The control signal supplied from the signal supplying unit 104 may include a driving pulse having rising of the signal level and falling of the signal level. In this case, the driving element 102 drives the heating element 101 while the driving pulse is applied.

As illustrated in FIG. 2, the control signal supplied from the signal supplying unit 104 includes a first driving pulse having a first pulse width pw1 and a second driving pulse having a second pulse width pw2 which is longer than the first pulse width pw1. A period of time from rising of the signal level to falling of the signal level corresponds to a pulse width.

The first driving pulse is a pre-driving pulse used to prevent variation of an ink discharge characteristic, for example. The heating element 101 may be preheated by the first driving pulse by supplying current to the heating element 101 to such an extent that ink is not discharged. The second driving pulse is a discharge driving pulse for discharging ink, for example. Use of the two driving pulses may enhance accuracy of discharge of liquid.

Here, in a case where the control signal includes a driving pulse having a pulse width shorter than a sum of the delay amounts of the plurality of delay circuits 105, it is highly likely that the overlap between timings of transition of the control signal occurs. Accordingly, in the case where the control signal includes the first driving pulse of a short pulse width and the second driving pulse of the long pulse width, an effect of reduction of possibility of malfunction of the discharge elements is remarkably obtained.

Figure 3:
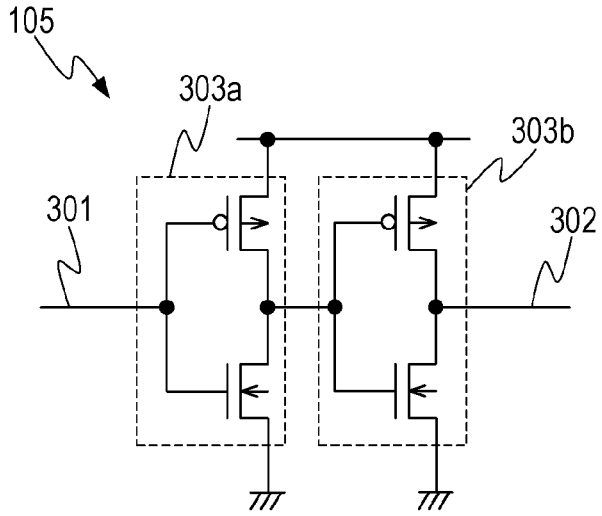
FIG. 3 is an equivalent circuit illustrating a configuration of a delay circuit.

Next, a configuration of the delay circuit 105 will be described in detail. FIG. 3 is an equivalent circuit illustrating a configuration of the delay circuit 105 of this embodiment.

The delay circuit 105 includes an input node 301 and an output node 302. The input node 301 or the output node 302 may include a buffer circuit. The delay circuit 105 of this embodiment includes a plurality of stages of inverter circuits 303. Each of the inverter circuits 303 includes a P-type MOS transistor and an N-type MOS transistor. With this configuration, a signal input to the input node 301 is output from the output node 302 after being delayed by a predetermined delay amount.

The delay amount may be determined in accordance with a gate length (channel length) of the transistor included in the delay circuit 105. Therefore, when the plurality of delay circuits 105 include transistors having different gate lengths, different delay amounts of the plurality of delay circuits 105 may be obtained.

Alternatively, the delay amount may be determined in accordance with the number of stages of the inverter circuits 303 included in the delay circuit 105. Therefore, when the plurality of delay circuits 105 include the inverter circuits 303 in different numbers of stages, different delay amounts of the plurality of delay circuits 105 may be obtained. Note that the inverter circuits 303 included in the delay circuit 105 may be replaced by logic gates, such as NAND circuits or OR circuits. Various delay amounts may be obtained when various types of logic gate are used.

Furthermore, the delay circuit 105 may be a CR circuit including a capacitance element and a resistance element. In a case where the delay circuits 105 are CR circuits, a time constant of at least one of the delay circuits 105 determined in accordance with a resistance value and a capacitance value is different from those of the other delay circuits 105.

In the example of FIG. 2, the delay amount tdb of the delay circuit 105*b* is smaller than the delay amount tda of the delay circuit 105*a*. However, even when the delay amount tdb of the delay circuit 105*b* is larger than the delay amount tda of the delay circuit 105*a*, the same effect may be obtained.

A modification of the delay amount of the delay circuit 105 will be described. In this modification, a plurality of heating elements 101 are arranged in n blocks in a divided manner. Here, "n" is an integer. Delay circuits 105 are disposed between adjacent two blocks in a signal path. Therefore, (n−1) delay circuits 105 are disposed.

Figure 4A:
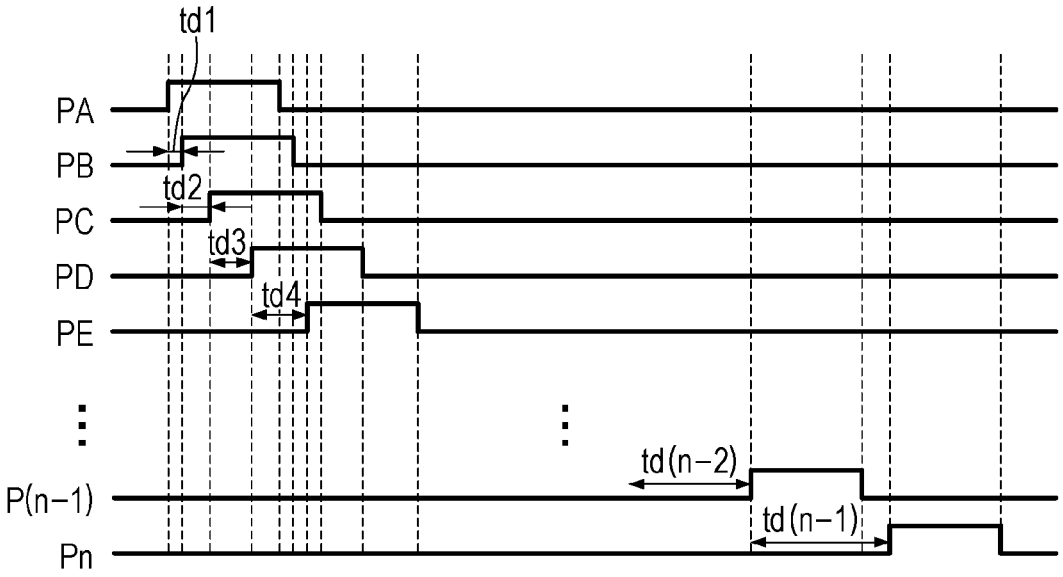
FIGS. 4A and 4B are diagrams schematically illustrating timing charts of a control signal.
Figure 4B:
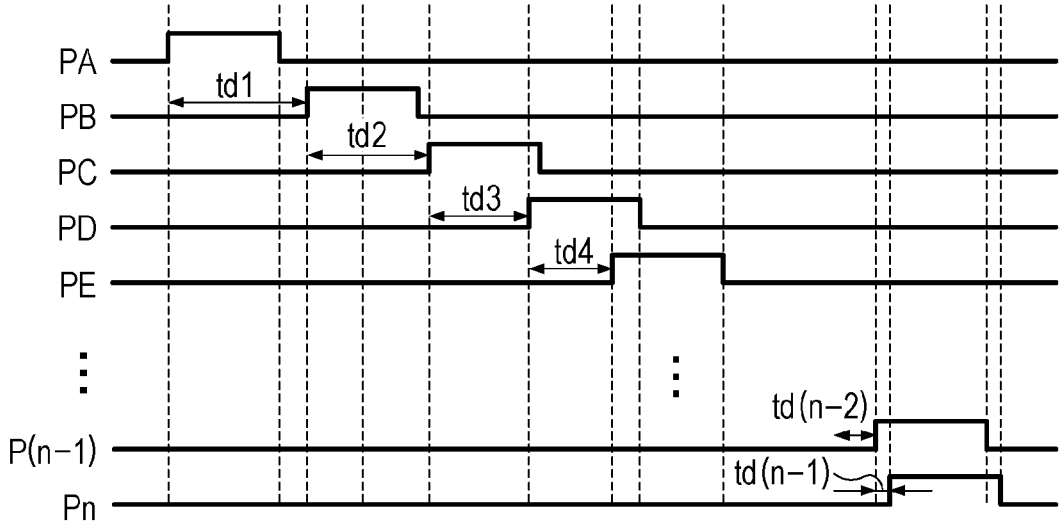

FIGS. 4A and 4B are diagrams schematically illustrating timing charts of a control signal according to the modification. Control signals PA to Pn of FIGS. 4A and 4B are supplied to driving elements 102 in blocks A to n. An axis of ordinate of FIG. 4 represents a signal level of the control signal.

The control signal is successively supplied to driving elements 102A to 102*n* from a signal supplying unit 104 through a plurality of delay circuits 105*a* to 105(*n*−1) disposed in the signal path.

In the example of FIG. 4A, a control signal obtained in a case where a delay amount td1 of the delay circuit 105*a* positioned nearest to the signal supplying unit 104 is smallest and delay amounts of td2 to td(n−1) of the delay circuits 105 are increased as the delay circuits 105 position far from the signal supplying unit 104 is illustrated. Specifically, the delay amounts td1 to td(n−1) of the plurality of delay circuits 105*a* to 105(*n*−1) satisfy the relationship "td1≤td2≤td3≤ . . . ≤td(n−2)≤td(n−1)".

In the example of FIG. 4B, a control signal obtained in a case where a delay amount td1 of the delay circuit 105*a* positioned nearest to the signal supplying unit 104 is largest and delay amounts of td2 to td(n−1) of the delay circuits 105 are reduced as the delay circuits 105 position far from the signal supplying unit 104 is illustrated. Specifically, the delay amounts td1 to td(n−1) of the plurality of delay circuits 105*a* to 105(*n*−1) satisfy the relationship "td1≥td2≥td3≥ . . . ≥td(n−2)≥td(n−1)".

As described above, since the delay amounts of the plurality of delay circuits are successively increased or reduced, overlap between timings of transition of the control signal may be further reduced. Consequently, possibility of malfunction of the discharge elements may be further reduced.

In the examples of FIGS. 4A and 4B, the delay amounts of the plurality of delay circuits are successively increased or reduced. However, the present invention is not limited to this, and the delay amounts of the plurality of delay circuits may be randomly or alternately changed. Furthermore, the plurality of delay circuits may have different delay amounts. Alternatively, some of the delay circuits may have the same delay amount. In particular, in a liquid discharge substrate including a large number of heating elements, if some of delay circuits have the same delay amount, a design efficiency may be improved.

In the circuit illustrated in FIG. 1, one terminal of the heating element 101 is connected to the node to which the power source voltage Vd is supplied. The other terminal of the heating element 101 is grounded through the driving element 102. However, the driving element 102 may be disposed between the one terminal of the heating element 101 and the node to which the power source voltage Vd is supplied. In a case where an N-type MOS transistor is used as the driving element 102, a drain is connected to the node to which the power source voltage Vd is supplied and a source is connected to the heating element 101.

Figure 5:
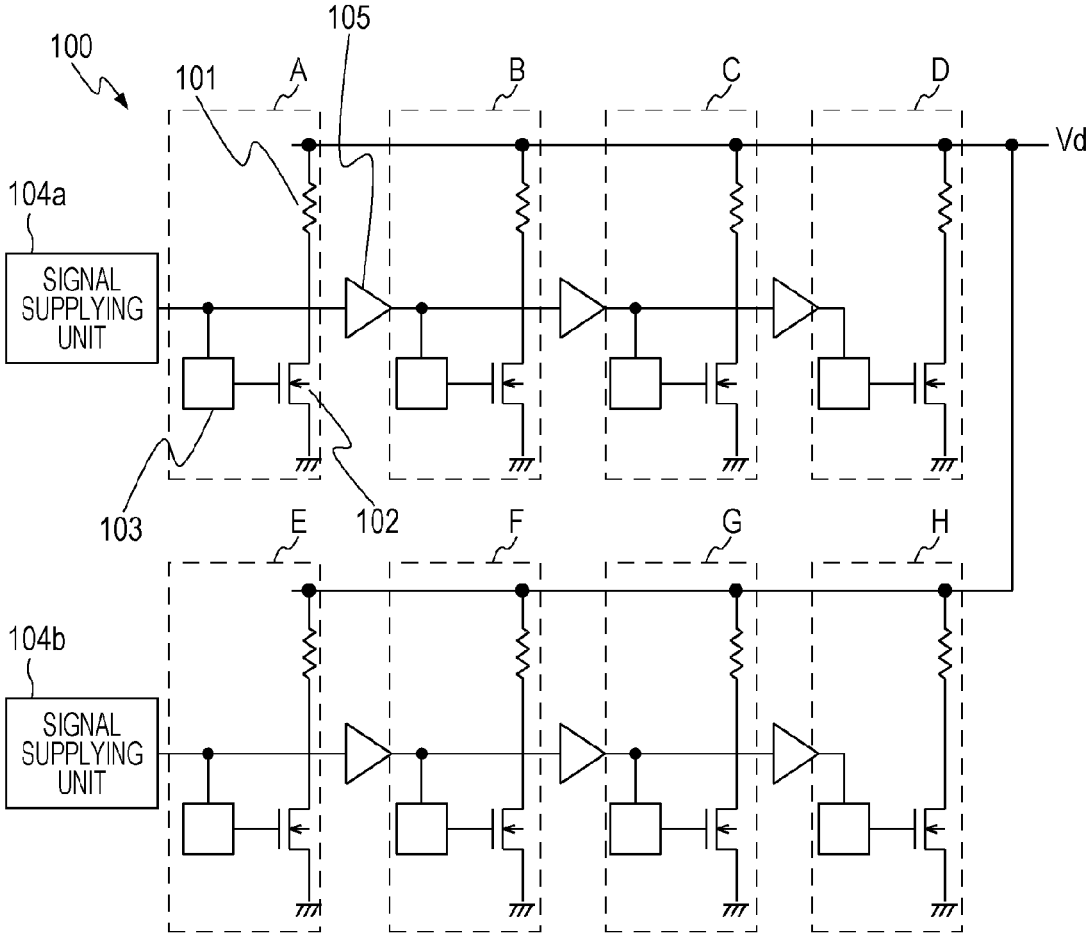
FIG. 5 is an equivalent circuit illustrating a configuration of a liquid discharge substrate.

The number of heating elements 101 is not limited to four as long as a plurality of heating elements 101 are disposed. FIG. 5 is an equivalent circuit illustrating a configuration of a delay circuit 100 of another modification. A plurality of heating elements 101 are arranged in eight blocks A to H in a divided manner. Although reference numerals are omitted in FIG. 5, each of the eight blocks A to H includes a heating element 101, a driving element 102, and a selection circuit 103. Reference numerals of delay circuits are also omitted.

A first signal supplying unit 104*a* supplies a control signal to selection circuits 103A to 103D. A second signal supplying unit 104*b* supplies a control signal to selection circuits 103E to 103H. The plurality of signal supplying units 104 may be disposed in this way. Furthermore, a node in which a power source is supplied to the blocks A to D and a node in which a power source is supplied to the blocks E to H may be separated from each other.

As described above, according to this embodiment, possibility of malfunction of discharge elements may be reduced.

Second Embodiment

A second embodiment will be described. This embodiment is characterized in that a plurality of transistors are disposed as a driving element for a single discharge element. Only portions different from the first embodiment are described and portions the same as the first embodiment are omitted.

Figure 6:
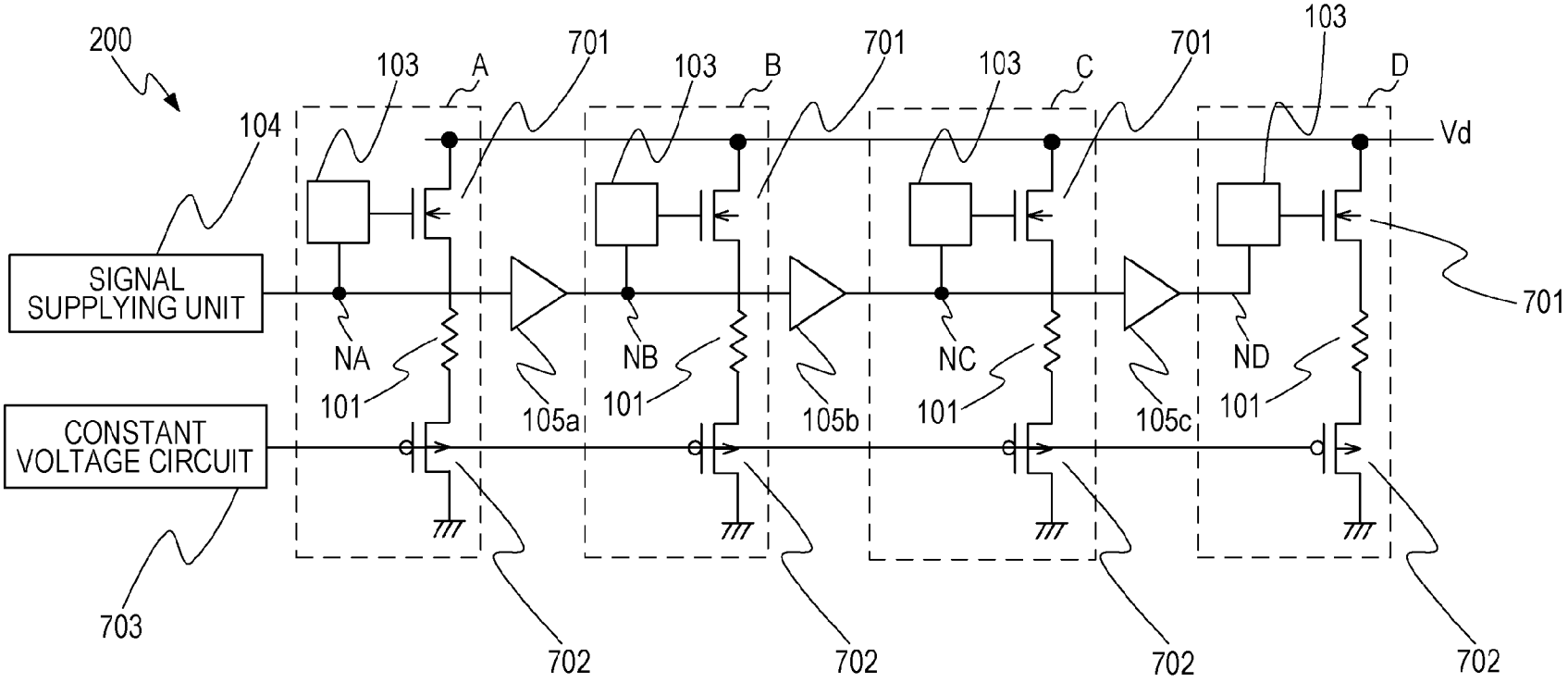
FIG. 6 is an equivalent circuit illustrating a configuration of a liquid discharge substrate.

FIG. 6 is an equivalent circuit illustrating a configuration of a liquid discharge substrate 200 of this embodiment. Portions having functions the same as those of the first embodiment are denoted by reference numerals the same as those of FIG. 1. Note that, although a line is omitted in FIG. 6, a selection signal PS is externally supplied to selection circuits 103.

In this embodiment, a driving element for a single heating element 101 includes a first transistor 701 and a second transistor 702. The first transistor 701 is an N-type MOS transistor, for example. A drain of the first transistor 701 is connected to a node to which a power source voltage Vd is supplied. A source of the first transistor 701 is connected to one terminal of the heating element 101. The second transistor 702 is a P-type MOS transistor, for example. A drain of the second transistor 702 is grounded. A source of the second transistor 702 is connected to the other terminal of the heating element 101.

A gate of the first transistor 701 is connected to the selection circuit 103. A signal supplying unit 104 supplies a control signal through the selection circuit 103 to the gate of the first transistor 701. As with the first embodiment, the signal supplying unit 104 successively supplies a control signal through a plurality of delay circuits delay circuits 105 to selection circuits 103A to 103D.

The liquid discharge substrate 200 includes a constant voltage circuit 703 which supplies a third voltage. The third voltage is different from the power source voltage Vd and a ground voltage. The constant voltage circuit 703 supplies the third voltage to a gate of the second transistor 702. With this configuration, a voltage is stably applied to the heating element 101. In particular, when the second transistor 702 constitutes a source follower circuit, a voltage is more stably applied to the heating element 101. The second transistor 702 functions as a source follower by setting a bias point such that the second transistor 702 performs a saturation operation.

Figure 7:
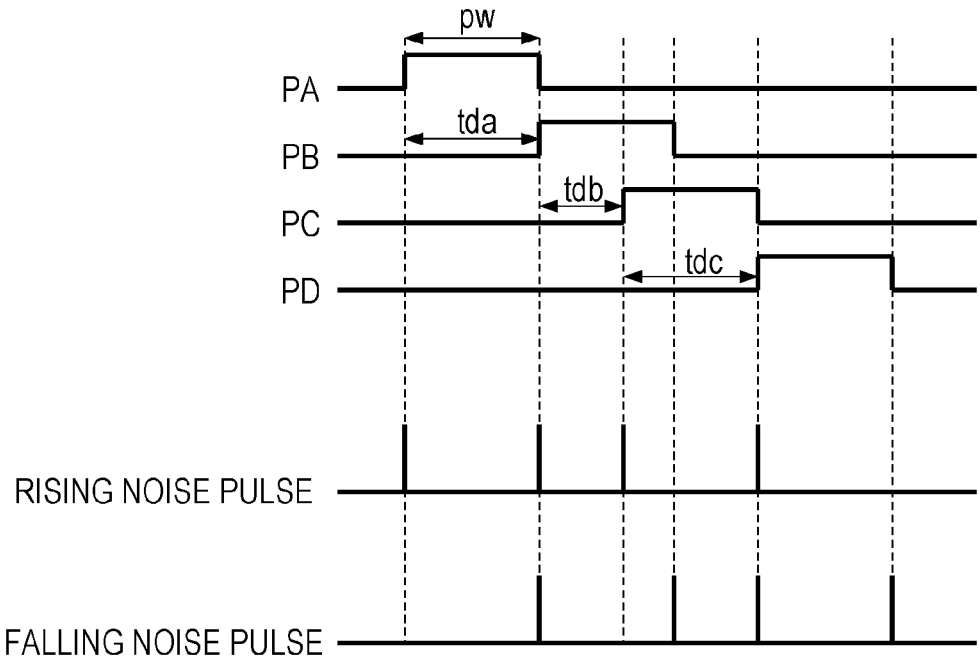
FIG. 7 is a diagram schematically illustrating a timing chart of a control signal.

FIG. 7 is a diagram schematically illustrating a timing chart of a control signal. Control signals PA to PD of FIG. 7 correspond to waveforms of a control signal supplied to nodes NA to ND of FIG. 6. An axis of ordinate of FIG. 7 represents a signal level of the control signal.

Furthermore, in FIG. 7, a noise pulse generated due to rising of a signal level of the control signal and a noise pulse generated due to falling of the signal level of the control signal are also schematically illustrated.

When a driving pulse rises, current is excessively supplied from a power source of the signal supplying unit 104 to the first transistor 701 so as to charge a gate capacitance of the first transistor 701. The rising noise pulse is generated due to the excessive current.

When the driving pulse falls, the first transistor 701 becomes in a non-conductive state, and therefore, a potential of the source of the first transistor 701 changes. Therefore, a potential of the source of the second transistor 702 changes, and a voltage of the gate of the second transistor 702 changes through a parasitic capacitance. The constant voltage circuit 703 charges the changed gate capacitance of the second transistor 702 so that the gate voltage of the second transistor 702 becomes stable. Therefore, current is excessively supplied from a power source of the constant voltage circuit 703 to the second transistor 702. The falling noise pulse is generated due to the excessive current.

Accordingly, when overlap between timings of transition of the control signal occurs, the rising noise pulse and the falling noise pulse overlap with each other and a large amount of current is supplied to a power source line and a ground line of the liquid discharge substrate 200. As a result, the discharge elements may malfunction.

The liquid discharge substrate 200 of this embodiment includes the plurality of delay circuits 105 having different delay amounts. With this configuration, overlap between timings of transition of the control signal may be reduced. Consequently, possibility of malfunction of the discharge elements may be reduced.

In particular, when two transistors are included in a driving element for a single heating element, the rising noise pulse and the falling noise pulse individually generate large amounts of current. Therefore, it is highly likely that the discharge elements malfunction. Accordingly, an effect of reduction of the malfunction of the discharge elements by reducing the overlap between timings of transition of the control signal may be more remarkably obtained.

A concrete configuration of a delay circuit 105 is the same as that of the first embodiment. That is, FIG. 3 is an equivalent circuit illustrating a configuration of the delay circuit 105 of this embodiment. A description of FIG. 3 and descriptions of modifications are the same as those of the first embodiment, and therefore, the descriptions are omitted.

Third Embodiment

A third embodiment will be described. In this embodiment, a plurality of heating elements are arranged in a plurality of blocks in a divided manner. Each of the plurality of blocks includes at least two heating elements. Furthermore, a first selection circuit which selects one of the blocks and a second selection circuit which selects one of the heating elements included in the block are provided. Only portions different from the first embodiment or the second embodiment are described and portions the same as the first embodiment or the second embodiment are omitted.

Figure 8:
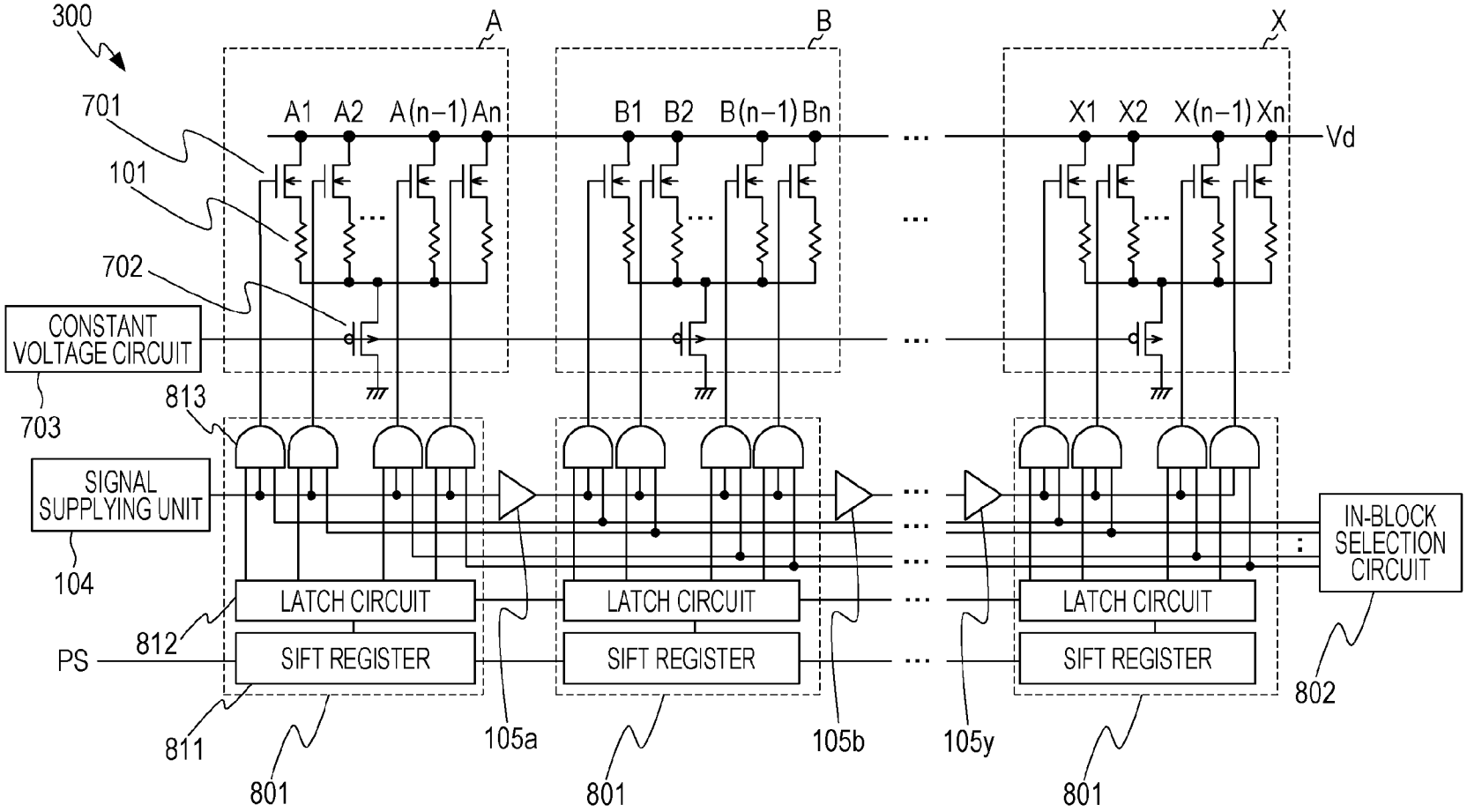
FIG. 8 is an equivalent circuit illustrating a configuration of a liquid discharge substrate.

FIG. 8 is an equivalent circuit illustrating a configuration of a liquid discharge substrate 300. Portions having functions the same as those of the first embodiment or the second embodiment are denoted by reference numerals the same as those of FIG. 1 or FIG. 6.

A plurality of heating elements 101 are arranged in a plurality of blocks A to X in a divided manner. Each of the blocks A to X includes n heating elements. When each of the heating elements 101 is referred to, an alphabet representing a corresponding one of the blocks A to X and a number for identifying the heating element 101 in the corresponding block are added after a reference numeral. For example, the block A includes a heating element 101A1 to a heating element 101An. The same is true for the elements other than the heating elements 101 and the circuits.

Each of driving elements of this embodiment includes a first transistor 701 and a second transistor 702.

One terminal of the heating element 101 is connected through the first transistor 701 to a node which receives a power source voltage Vd supplied thereto. The heating element 101 and the first transistor 701 are disposed in the one-to-one relationship. The other terminal of the heating element 101 is grounded through the second transistor 702. The second transistor 702 is shared by the plurality of heating elements 101 in the same block. That is, each block includes one second transistor 702. A constant voltage circuit 703 supplies a third voltage to a gate of the second transistor 702.

A gate of the first transistor 701 is connected to a first selection circuit 801. One first selection circuit 801 is assigned to one block. The first selection circuit 801 includes a shift register 811, a latch circuit 812, and n AND circuits 813 corresponding to a number of (n) heating elements 101 included in one block.

A selection signal PS is input to a shift register 811A, and is sequentially supplied to shift registers 811B to 811X. The latch circuit 812 holds a selection signal output from the shift register 811 in accordance with a latch pulse.

Each of the AND circuits 813 has three input nodes. A first input node is connected to a second selection circuit 802. The second selection circuit 802 selects one of the plurality of heating elements 101 to be driven included in the same block. The second selection circuit 802 includes an address decoder and a counter, for example. A second input node is connected to the latch circuit 812. A third input node receives a control signal supplied from a signal supplying unit 104.

In this embodiment, a plurality of delay circuits 105*a* to 105*y* are disposed in a signal path which transmits the control signal supplied by the signal supplying unit 104. The delay circuit 105*a* is disposed between an AND circuit 813A of the block A and an AND circuit 813B of the block B in the signal path. With this configuration, the delay circuit 105*a* may delay a timing when the control signal is supplied to a driving element of the block B relative to a timing when the control signal is supplied to the driving element of the block A. This is true for the other delay circuits 105*b* to 105*y*. In this embodiment, delay amounts of all the delay circuits 105 are the same.

In the liquid discharge substrate 300 of this embodiment, the selection signal PS selects one of the blocks A to X and the second selection circuit 802 selects one of the driving elements included in the selected block. A driving element selected by the selection signal PS and the second selection circuit 802 drives a corresponding one of the heating elements 101 at a timing when the control signal is supplied from the signal supplying unit 104.

As described above, one delay circuit 105 is disposed for one block in this embodiment. The first selection circuit 801 and the second selection circuit 802 are provided for driving one heating element 101 for each block. With this configuration, the number of heating elements 101 which operate in accordance with a driving pulse may be reduced. Therefore, noise generated when overlap between timings of transition of the control signal occurs may be reduced. Consequently, possibility of malfunction of the discharge elements may be reduced.

In this embodiment, delay amounts of all the delay circuits 105 are the same. However, as with the first and second embodiments, the liquid discharge substrate 300 may include at least two delay circuits 105 having different delay amounts. With this configuration, as with the first and second embodiments, possibility of malfunction of the discharge elements may be reduced.

A concrete configuration of the delay circuit 105 is the same as that of the first embodiment. That is, FIG. 3 is an equivalent circuit illustrating a configuration of the delay circuit 105 of this embodiment. A description of FIG. 3 and descriptions of modifications are the same as those of the first embodiment, and therefore, the descriptions are omitted.

Fourth Embodiment

A printing apparatus according to a fourth embodiment of the present invention will be described. An inkjet printing apparatus 900 will be described. A printing head 810 of the printing apparatus 900 includes one of the liquid discharge substrates 100, 200, and 300 described in the first to third embodiments, respectively, and a liquid supplying unit.

Figure 9A:
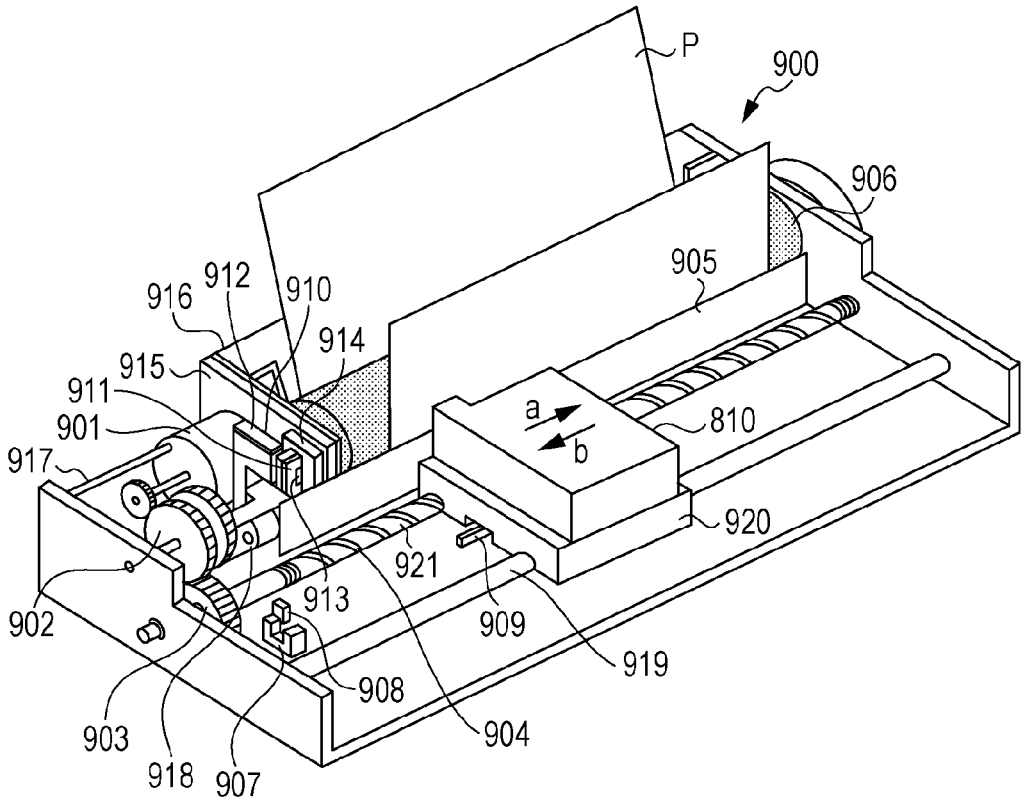
FIGS. 9A and 9B are diagrams schematically illustrating a configuration of a printing apparatus.

FIG. 9A is a perspective view of an appearance of the inkjet printing apparatus 900 according to this embodiment of the present invention. In FIG. 9A, the printing head 810 is mounted on a carriage 920 which is meshed with a spiral groove 921 of a lead screw 904 which is rotated using driving-force transmission gears 902 and 903 along with normal rotation and backward rotation of a driving motor 901. With this configuration, the printing head 810 is reciprocally movable in directions denoted by an arrow mark a and an arrow mark b along a guide 919 together with the carriage 920 by a driving force of the driving motor 901. A sheet pressing plate 905 for a printing sheet P which is conveyed on a platen 906 by a printing medium feeding device, not illustrated, presses the printing sheet P against the platen 906 in a carriage moving direction.

A photo-coupler 907 and 908 serves as a home position detector for detecting a lever 909 disposed on the carriage 920 in a region including the photo-coupler 907 and 908 so that switching of a rotation direction of the driving motor 901 is performed. A supporting member 910 supports a capping member 911 which caps an entire surface of the printing head 810. A suction unit 912 performs suction in an interior of the capping member 911 so as to perform suction recovery of the printing head 810 through an opening 913 in the capping member 911. A movement member 915 moves a cleaning blade 914 in a back-and-forth direction. The cleaning blade 914 and the movement member 915 are supported by a body supporting plate 916. Instead of the cleaning blade 914 illustrated in FIG. 9A, general cleaning blades may be employed in this embodiment. Furthermore, a lever 917 is used to start the suction for the suction recovery, is moved in accordance with movement of a cam 918 which is to be meshed with the carriage 920, and is controlled to be moved by receiving a driving force supplied from the driving motor 901 by a general transmission method, such as clutch switching. A printing controller (not illustrated) which supplies a signal to a heating unit included in the printing head 810 and which controls driving of various mechanisms including the driving motor 901 is disposed on an apparatus body.

The inkjet printing apparatus 900 having the configuration described above performs printing while the printing head 810 reciprocally moves on the printing sheet P conveyed on the platen 906 by the printing medium feeding device in an entire width of the printing sheet P. The printing head 810 uses a base of the inkjet printing head according to one of the first to third embodiments, and therefore, malfunction of a printing element may be reduced.

Figure 9B:
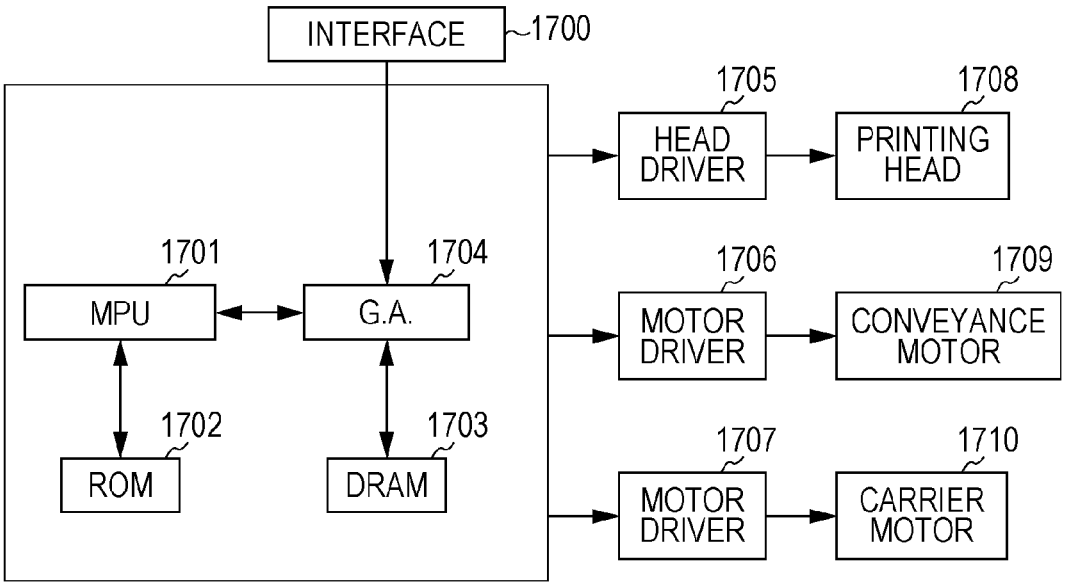

Next, a configuration of a control circuit which executes printing control of the apparatus described above will be described. FIG. 9B is a block diagram illustrating a configuration of a control circuit of the inkjet printing apparatus 900. The control circuit includes an interface 1700 which receives a printing signal supplied thereto, a microprocessor (MPU) 1701, a program read only memory (ROM) 1702, a dynamic random access memory (RAM) 1703, and a gate array 1704. The program ROM 1702 stores control programs to be executed by the MPU 1701. The dynamic RAM 1703 stores the printing signal described above and various data including printing data to be supplied to the head. The gate array 1704 performs control of supply of the printing data to a printing head 1708. The gate array 1704 further performs control of data transfer among the interface 1700, the MPU 1701, and the RAM 1703. The control circuit further includes a carrier motor 1710 used to convey the printing head 1708 and a conveyance motor 1709 used to convey a printing sheet. The control circuit still further includes a head driver 1705 which drives the printing head 1708 and motor drivers 1706 and 1707 which drive the conveyance motor 1709 and the carrier motor 1710, respectively.

Operation of the control configuration will be described. When a printing signal is supplied to the interface 1700, the printing signal is converted into printing data for printing between the gate array 1704 and the MPU 1701. Thereafter, the motor drivers 1706 and 1707 are driven and the printing head is also driven in accordance with the printing data supplied to the head driver 1705 so that printing is performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-093087, filed Apr. 28, 2014, which is hereby incorporated by reference herein in its entirety.

What is claimed is:

1. A liquid discharge substrate, comprising:

a plurality of discharge elements configured to receive a power source supplied from a common power source line;

a plurality of driving elements configured to drive the plurality of discharge elements;

a signal supplying unit configured to supply a control signal for controlling the plurality of driving elements; and a plurality of delay circuits disposed in a signal path which transmits the control signal, wherein the plurality of driving elements include first, second, and third driving elements, the plurality of delay circuits include first and second delay circuits, the first delay circuit delays a timing when the discharge element corresponding to the second driving element is driven relative to a timing when the discharge element corresponding to the first driving element is driven, the second delay circuit delays a timing when the discharge element corresponding to the third driving element is driven relative to the timing when the discharge element corresponding to the second driving element is driven, a delay amount of the first delay circuit is different from a delay amount of the second delay circuit, and delay amounts of more than two of the delay circuits arranged in series are sequentially increased or reduced.

2. The liquid discharge substrate according to claim 1, wherein a gate length of a transistor included in the first delay circuit is different from a gate length of a transistor included in the second delay circuit.

3. The liquid discharge substrate according to claim 1, wherein each of the plurality of delay circuits includes a logic circuit, and a configuration of the logic circuit included in the first delay circuit is different from a configuration of the logic circuit included in the second delay circuit.

4. The liquid discharge substrate according to claim 1, wherein each of the plurality of delay circuits include a resistance element and a capacitance element, and a time constant determined by the resistance element and the capacitance element included in the first delay circuit is different from a time constant determined by the resistance element and the capacitance element included in the second delay circuit.

5. The liquid discharge substrate according to claim 1, wherein the control signal includes a first driving pulse having a first pulse width and a second driving pulse having a second pulse width which is longer than the first pulse width.

6. The liquid discharge substrate according to claim 1, wherein the control signal includes a driving pulse having a pulse width which is shorter than a sum of delay amounts of the plurality of delay circuits.

7. The liquid discharge substrate according to claim 1, further comprising:

selection circuits configured to select at least one of the plurality of discharge elements, wherein the plurality of driving elements are controlled by the control signal and a selection signal input to the selection circuits.

8. The liquid discharge substrate according to claim 7, wherein one of the first and second driving elements is selected by a corresponding one of the selection circuits.

9. The liquid discharge substrate according to claim 7, wherein at least two driving elements including the second driving element are disposed between the first delay circuit and the second delay circuit in the signal path, and at least one of the two driving elements is selected by a corresponding one of the selection circuits.

10. The liquid discharge substrate according to claim 1, wherein the plurality of discharge elements are arranged in a plurality of blocks in a divided manner, each of the blocks including at least two of the discharge elements, and the liquid discharge substrate includes first selection circuits configured to select at least one of the plurality of blocks, and a second selection circuit configured to select one of the at least two discharge elements included in the selected block.

11. The liquid discharge substrate according to claim 1, wherein each of the driving elements include a transistor, one of a drain and a source of the transistor is connected to a node to which a first voltage is supplied, the other of the drain and the source of the transistor is connected to a first terminal of the discharge element, a second terminal of the discharge element is connected to a node to which a second voltage which is different from the first voltage is supplied, and a signal based on the control signal is supplied to a gate of the transistor.

12. The liquid discharge substrate according to claim 1, wherein each of the plurality of driving elements includes a first transistor and a second transistor, one of a drain and a source of the first transistor is connected to a node to which a first voltage is supplied, the other of the drain and the source of the first transistor is connected to a first terminal of the discharge element, a second terminal of the discharge element is connected to one of a drain and a source of the second transistor, the other of the drain and the source of the second transistor is connected to a node to which a second voltage which is different from the first voltage is supplied, a signal based on the control signal is supplied to a gate of the first transistor, and a third voltage is supplied to a gate of the second transistor.

13. The liquid discharge substrate according to claim 12, wherein the plurality of discharge elements are arranged in a plurality of blocks in a divided manner, each of the blocks including at least two of the discharge elements, and the at least two discharge elements included in one block are connected to the single second transistor.

14. The liquid discharge substrate according to claim 12, wherein the second transistor forms a source follower circuit.

15. The liquid discharge substrate according to claim 1, wherein delay amounts of the plurality of delay circuits are different from one another.

16. A liquid discharge head, comprising:

the liquid discharge substrate set forth in claim 1; and a liquid supplying unit configured to supply liquid to the liquid discharge substrate.

17. A liquid discharge substrate, comprising:

a plurality of discharge elements;

a plurality of driving elements configured to drive the plurality of discharge elements;

a signal supplying unit configured to supply a control signal for controlling the plurality of driving elements; and a plurality of delay circuits disposed in a signal path which transmits the control signal, wherein the plurality of discharge elements are arranged in a plurality of blocks in a divided manner, each of the blocks including at least one of the discharge elements, the plurality of blocks include first, second, and third blocks which are sequentially arranged, the plurality of driving elements include a first driving element which drives the discharge element of the first block, a second driving element which drives the discharge element of the second block, and a third driving element which drives the discharge element of the third block, the plurality of delay circuits include a first delay circuit disposed in the signal path between the first driving element and the second driving element and a second delay circuit disposed in the signal path between the second driving element and the third driving element, a delay amount of the first delay circuit is different from a delay amount of the second delay circuit, and delay amounts of more than two of the delay circuits arranged in series are sequentially increased or reduced.

18. A liquid discharge substrate, comprising:

a plurality of discharge elements;

a plurality of driving elements configured to drive the plurality of discharge elements;

a signal supplying unit configured to supply a control signal for controlling the plurality of driving elements; and a plurality of delay circuits disposed in a signal path which transmits the control signal, wherein the plurality of discharge elements are arranged in a plurality of blocks in a divided manner, each of the blocks including at least one of the discharge elements, the plurality of blocks include first, second, and third blocks which are sequentially arranged, the plurality of driving elements include a first driving element which drives the discharge element of the first block, a second driving element which drives the discharge element of the second block, and a third driving element which drives the discharge element of the third block, the plurality of delay circuits include a first delay circuit disposed in the signal path between the first driving element and the second driving element and a second delay circuit disposed in the signal path between the second driving element and the third driving element, and a gate length of a transistor included in the first delay circuit is different from a gate length of a transistor included in the second delay circuit.

19. The liquid discharge substrate according to claim 18, wherein in more than two of the delay circuits arranged in series, the number of stages of logic gates sequentially increases or decreases.

20. A liquid discharge substrate, comprising:

a plurality of discharge elements;

a plurality of driving elements configured to drive the plurality of discharge elements;

a signal supplying unit configured to supply a control signal for controlling the plurality of driving elements; and a plurality of logic circuits disposed in a signal path which transmits the control signal, wherein the plurality of discharge elements are arranged in a plurality of blocks in a divided manner, each of the blocks including at least one of the discharge elements, the plurality of blocks include first, second, and third blocks which are sequentially arranged, the plurality of driving elements include a first driving element which drives the discharge element of the first block, a second driving element which drives the discharge element of the second block, and a third driving element which drives the discharge element of the third block, the plurality of logic circuits include a first logic circuit disposed in the signal path between the first driving element and the second driving element and a second logic circuit disposed in the signal path between the second driving element and the third driving element, and a number of stages of logic gates included in the first logic circuit is different from a number of stages of logic gates included in the second logic circuit.

21. The liquid discharge substrate according to claim 20, wherein in more than two of the logic circuits arranged in series, the gate length of the transistor sequentially increases or decreases.

* * * * *